US011135608B2

(12) United States Patent
Alluigi

(10) Patent No.: US 11,135,608 B2
(45) Date of Patent: Oct. 5, 2021

(54) DISPENSING DEVICE FOR PASTE PRODUCTS

(71) Applicant: GUALA DISPENSING S.P.A., Alessandria (IT)

(72) Inventor: Riccardo Alluigi, Alessandria (IT)

(73) Assignee: GUALA DISPENSING S.P.A., Alessandria (IT)

( * ) Notice: Subject to any disclaimer, the term of this patent is extended or adjusted under 35 U.S.C. 154(b) by 0 days.

(21) Appl. No.: 16/967,757

(22) PCT Filed: Feb. 5, 2019

(86) PCT No.: PCT/IB2019/050910
§ 371 (c)(1),
(2) Date: Aug. 6, 2020

(87) PCT Pub. No.: WO2019/162784
PCT Pub. Date: Aug. 29, 2019

(65) Prior Publication Data

US 2020/0384490 A1 Dec. 10, 2020

(30) Foreign Application Priority Data

Feb. 23, 2018 (IT) ..... 102018000002991

(51) Int. Cl.
*B05B 11/00* (2006.01)
*A47K 5/12* (2006.01)
*B65D 83/00* (2006.01)

(52) U.S. Cl.
CPC ..... *B05B 11/303* (2013.01); *A47K 5/1201* (2013.01); *A47K 5/1209* (2013.01); (Continued)

(58) Field of Classification Search
CPC ..... B05B 11/303; B05B 11/3059; B05B 11/3028; B05B 11/3029; B05B 11/3032; (Continued)

(56) References Cited

U.S. PATENT DOCUMENTS 3,469,746 A * 9/1969 Melocchi ..... B65D 83/40 222/182
4,154,371 A * 5/1979 Kolaczinski ..... B65D 35/30 222/212

(Continued)

FOREIGN PATENT DOCUMENTS

EP 0286608 A2 10/1988
EP 351517 A1 1/1990

(Continued)

OTHER PUBLICATIONS

International Search Report and Written Opinion for International Patent Application No. PCT/IB2019/050910, dated Apr. 5, 2019, 12 pages.

*Primary Examiner* — Paul R Durand
*Assistant Examiner* — Randall A Gruby
(74) *Attorney, Agent, or Firm* — Armstrong Teasdale LLP

(57) ABSTRACT

A dispensing device for paste products, including toothpaste, is provided. The dispensing device includes a container, a pumping diaphragm and a head applied to the container. The head is equipped with a tube and a button for acting on the diaphragm and deforming it for dispensing. The button has a pressure surface for a user's dispensing action. An extension element which, in an active position, is arranged as an extension of the pressure surface of the button, increases a leverage effect.

15 Claims, 8 Drawing Sheets

(52) U.S. Cl.
CPC ..... *A47K 5/1211* (2013.01); *B05B 11/3059* (2013.01); *B65D 83/0033* (2013.01)

(58) Field of Classification Search
CPC ..... B05B 11/3033; B05B 11/3035; B05B 11/3036; A47K 5/1201; A47K 5/1209; B65D 83/0033
See application file for complete search history.

(56) References Cited

U.S. PATENT DOCUMENTS 4,629,097 A * 12/1986 Moore ..... B65D 83/0033 222/153.13
4,684,043 A * 8/1987 Foster ..... B67D 7/0205 222/257
4,691,847 A * 9/1987 Ford ..... A47K 5/18 222/259
4,776,496 A * 10/1988 Battegazzore ..... B65D 83/0033 222/209
4,793,522 A * 12/1988 Corsette ..... B65D 83/0033 222/257
4,830,221 A * 5/1989 Mazzanobile ..... A61Q 11/00 222/260
4,936,493 A * 6/1990 Foster ..... B05B 11/0048 137/846
5,104,009 A * 4/1992 Battegazzore ..... B65D 83/0033 222/209
5,135,738 A * 8/1992 Gaffar ..... A61K 8/347 206/277
5,167,951 A * 12/1992 Gaffar ..... A61K 8/347 206/524.1
5,176,291 A * 1/1993 Fillmore ..... B65D 83/0033 222/1
5,279,813 A * 1/1994 Gaffar ..... A61K 8/046 206/277
7,195,136 B2 * 3/2007 von Schuckmann ..... B65D 83/0033 222/209
2006/0243754 A1 * 11/2006 Rackwitz ..... B65D 83/44 222/402.15
2016/0167074 A1 6/2016 Beckerman

FOREIGN PATENT DOCUMENTS

JP H07242278 A 9/1995
JP H09122545 A 5/1997
JP 2011242029 A 12/2011

* cited by examiner

DISPENSING DEVICE FOR PASTE PRODUCTS

CROSS-REFERENCE TO RELATED APPLICATIONS

This application is a National Stage Application of International Patent Application No. PCT/IB2019/050910, having an International Filing Date of Feb. 5, 2019, which claims the benefit of priority to Italian Patent Application No. 102018000002991, filed Feb. 23, 2018, the entire contents of which are hereby incorporated by reference herein.

FIELD OF THE INVENTION

The object of the present invention is a device for the manual dispensing of paste products, such as, in particular, toothpaste. In particular, the object of the present invention is a dispensing device equipped with means that facilitate the dispensing of the product.

BACKGROUND OF THE INVENTION

As is well known, such devices, especially if intended for dispensing toothpaste, are widespread and are now part of the daily life of consumers.

Generally, such devices are composed of a rigid container, usually cylindrical, at the top of which is placed a button.

When the proper pressure is exerted on the button, it undergoes a rotation, frees a dispensing mouth and causes the release of a predefined quantity of product.

Since the product, and especially toothpaste, is dense or semi-dense, the action on the button required for dispensing may be relatively substantial; this sometimes involves needing to help children in such an operation, as they are unable to press the button properly.

Solutions are known for dispensing devices designed to overcome this problem. An example is described in the document US2016/0167074, wherein a particularly long lever is provided for dispensing the product.

However, this and similar solutions have some drawbacks, due to the fact that, by distorting the overall dimensions, it would be very expensive to design new assembly and filling lines and new transport systems for such devices.

SUMMARY OF THE INVENTION

The object of the present invention is to satisfy the requirements of the sector and to overcome the drawbacks mentioned with reference to the prior art.

Such object is achieved by a dispensing device for paste products, including toothpaste, as described and claimed herein. Advantageous embodiments are also described.

BRIEF DESCRIPTION OF THE DRAWINGS

The features and advantages of the dispensing device according to the present invention will be apparent from the description given below, provided by way of non-limiting example, in accordance with the accompanying figures, wherein.

DETAILED DESCRIPTION

Figure 1C:
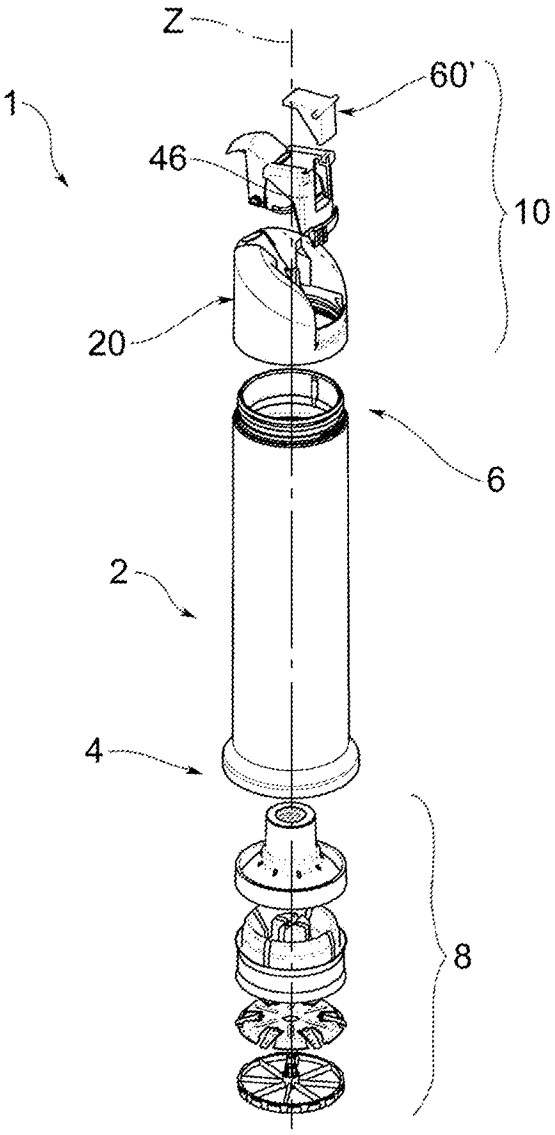
FIG. 1*a* to 1*c* represent a dispensing device according to an embodiment of the present invention.
Figure 1B:
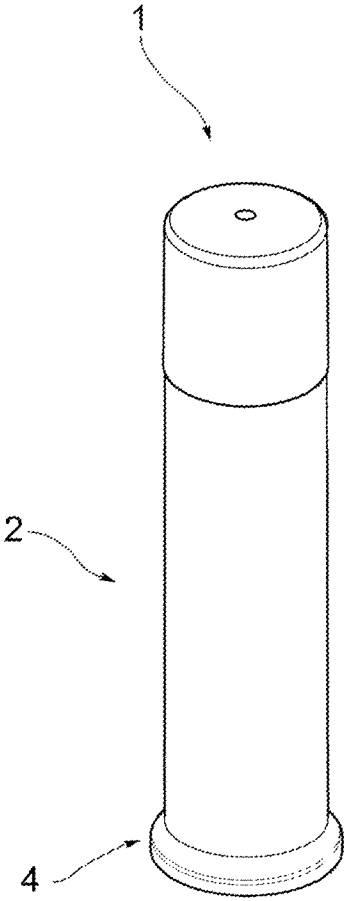
Figure 1A:
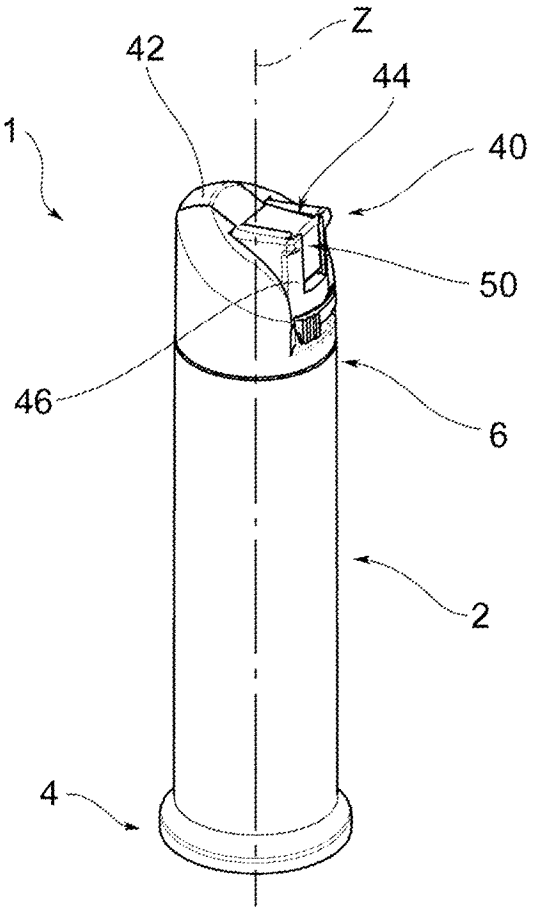
Figure 2B:
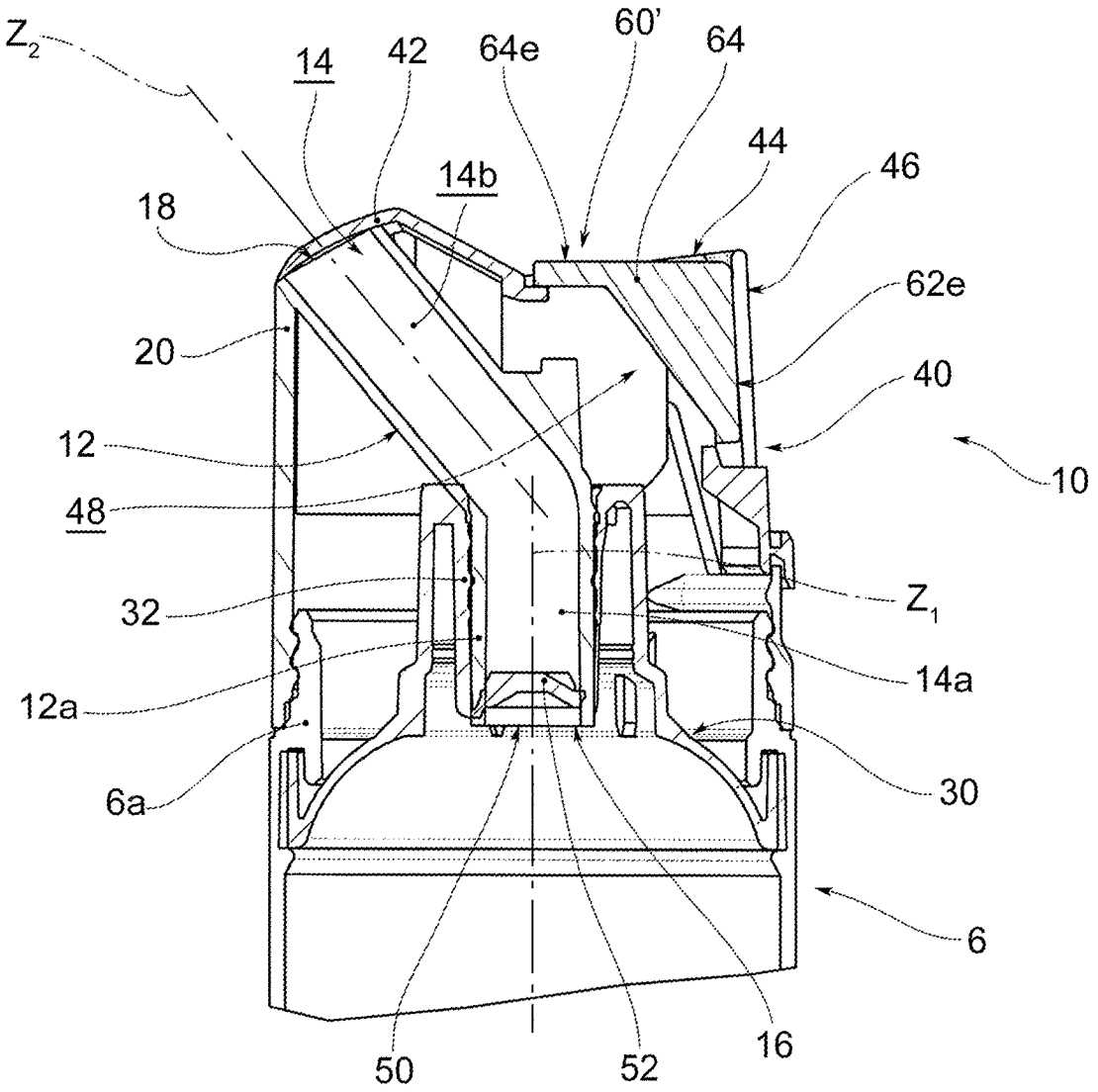
FIG. 2*b* shows an enlargement of the detail II of FIG. 2*a;*
Figure 2A:
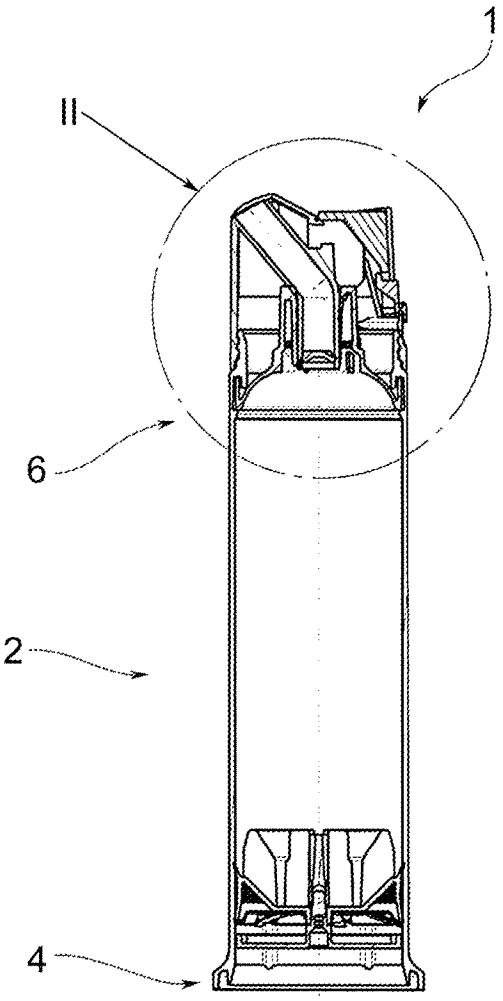
FIG. 2*a* illustrates a longitudinal section of the dispensing device of FIG. 1*a* in a rest configuration.
Figure 3B:
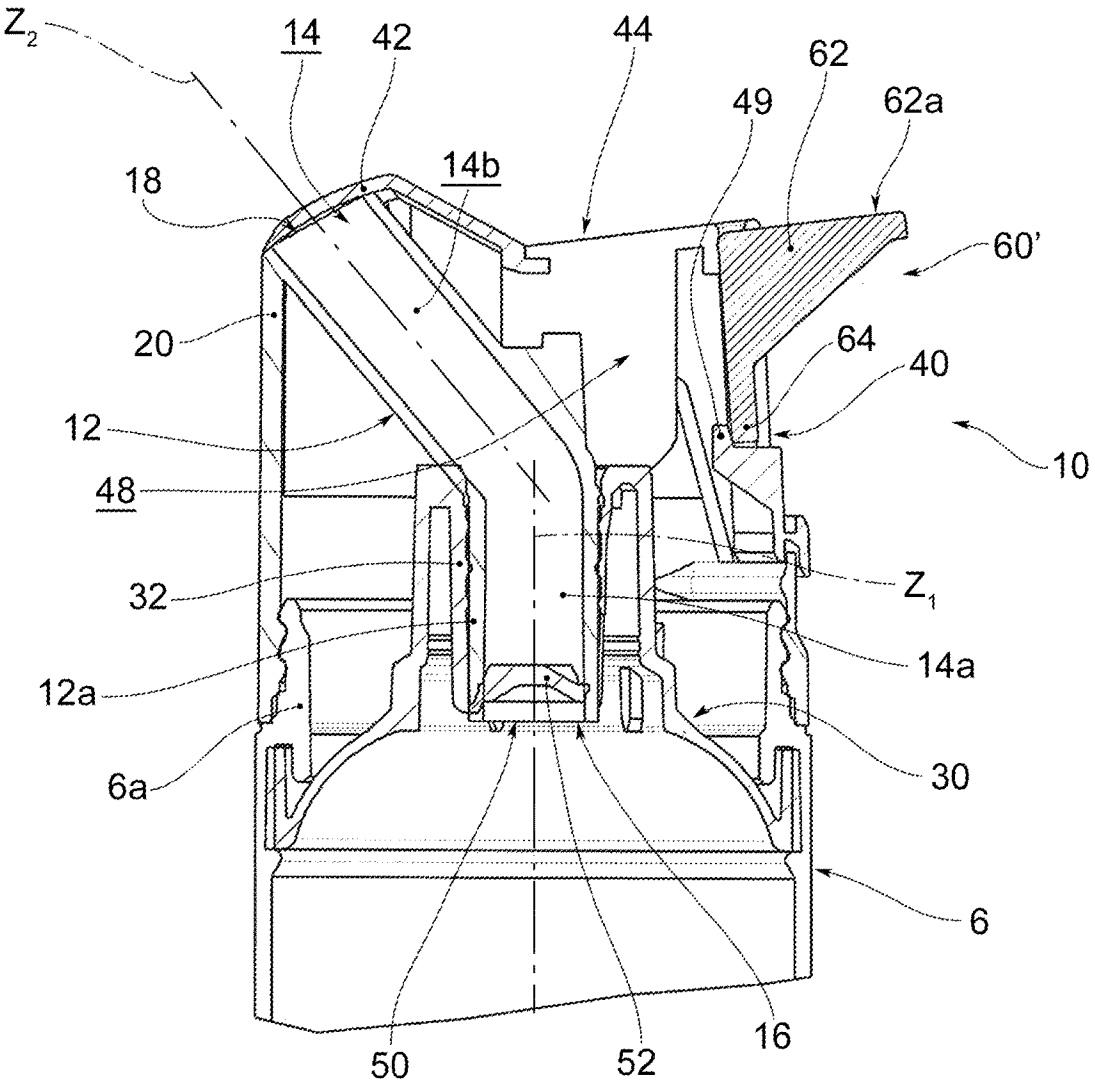
FIG. 3*b* shows an enlargement of the detail III of FIG. 3*a;*
Figure 3A:
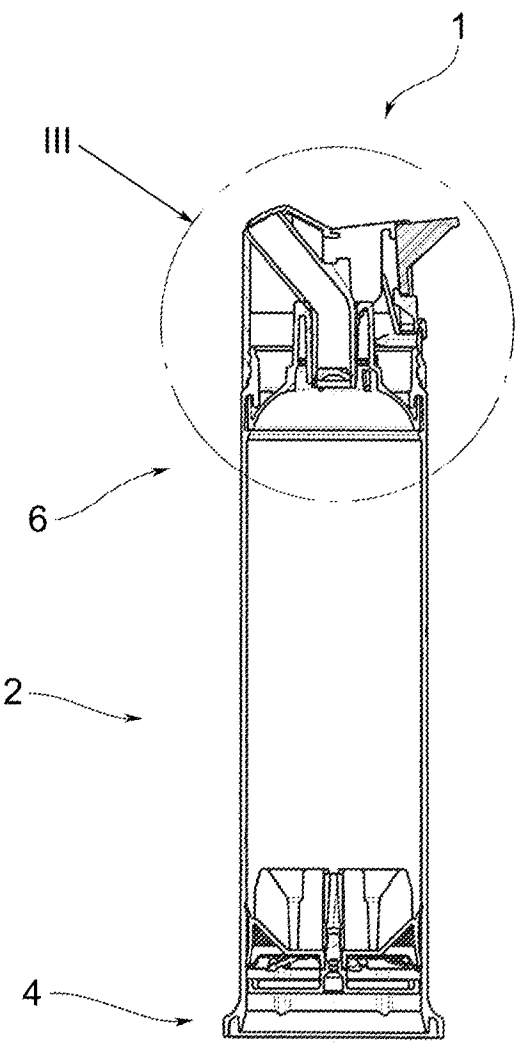
FIG. 3*a* illustrates a longitudinal section of the dispensing device of FIG. 1*a* in an extended configuration.
Figure 4B:
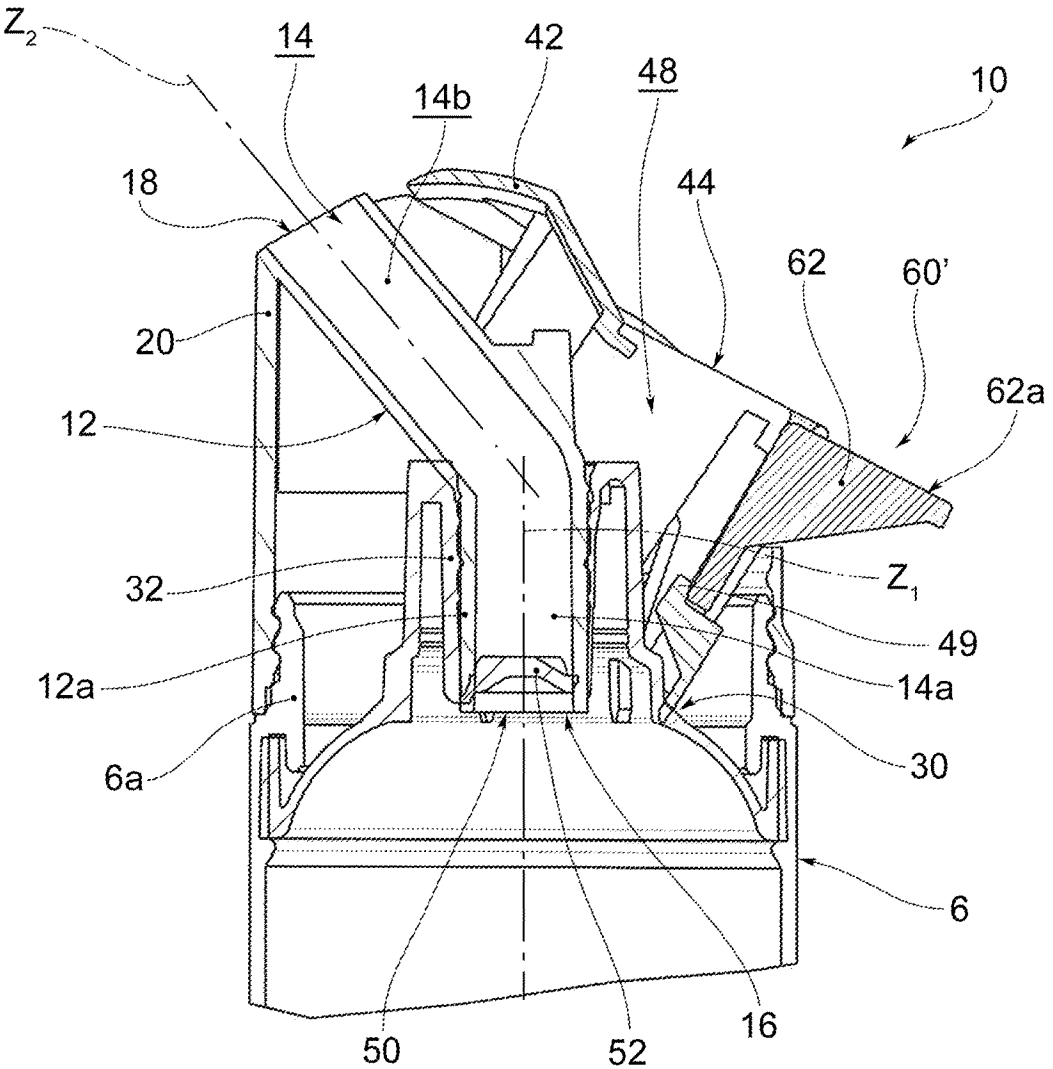
FIG. 4*b* shows an enlargement of the detail IV of FIG. 4*a;*
Figure 4A:
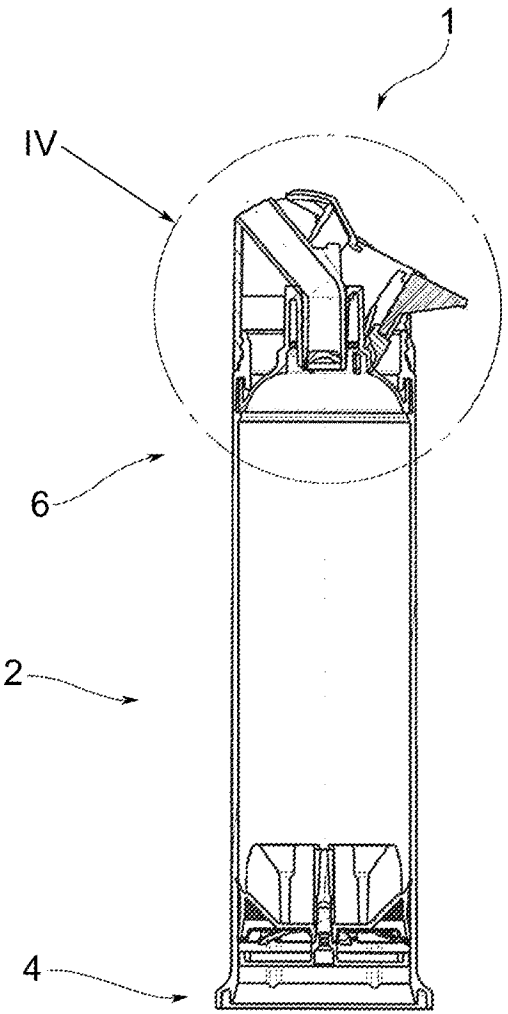
FIG. 4*a* illustrates a longitudinal section of the dispensing device of FIG. 1*a* in a dispensing configuration.
Figure 5C:
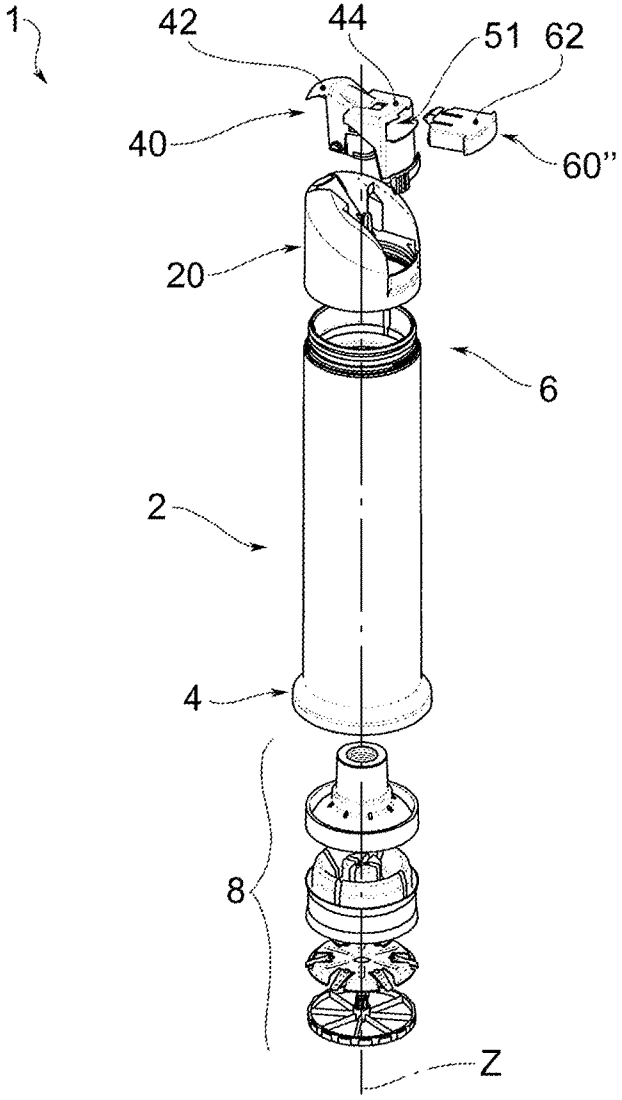
FIGS. 5*a* to 5*c* represent a dispensing device according to a further embodiment of the present invention.
Figure 5B:
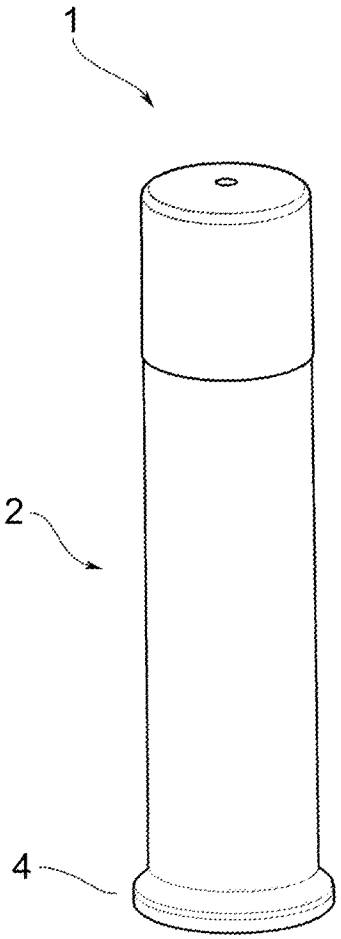
Figure 5A:
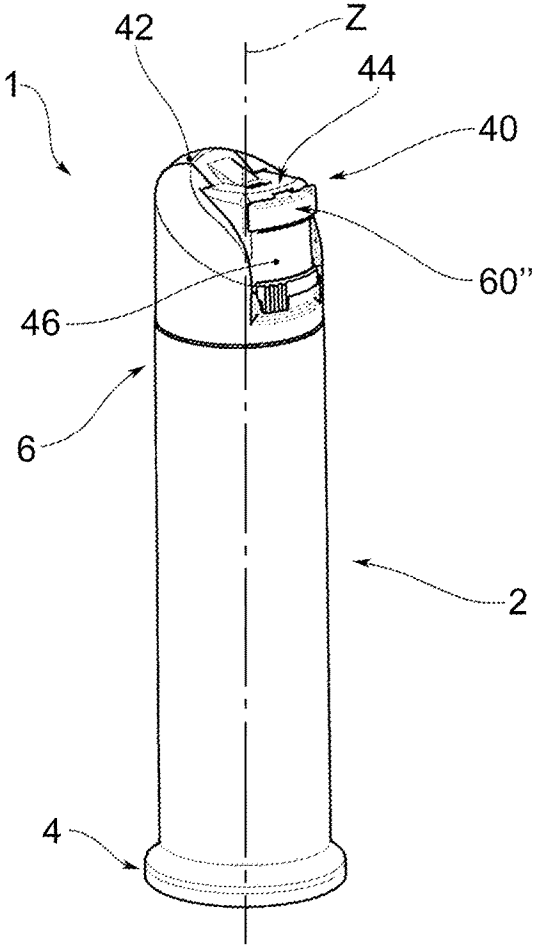
Figure 6B:
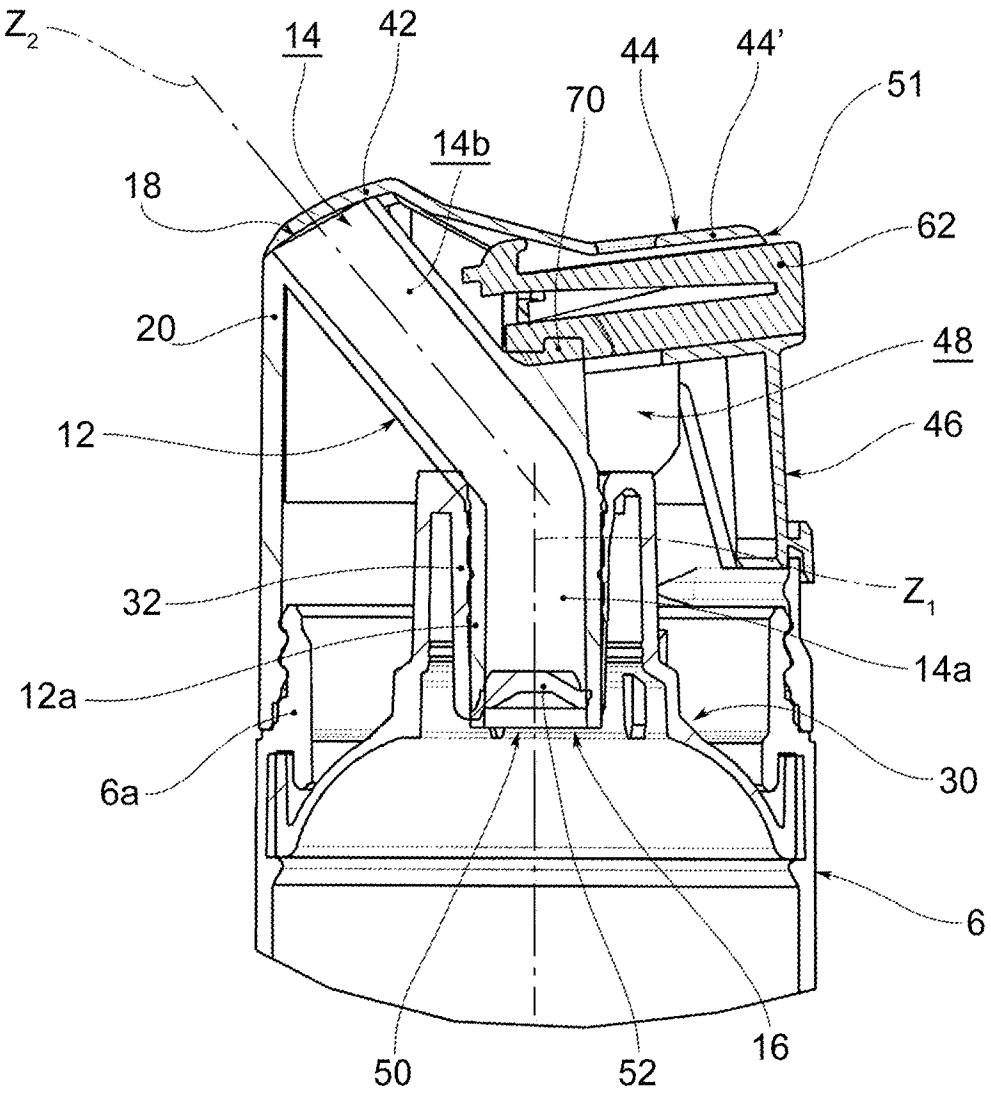
FIG. 6*b* shows an enlargement of the detail IV of FIG. 6*a;*
Figure 6A:
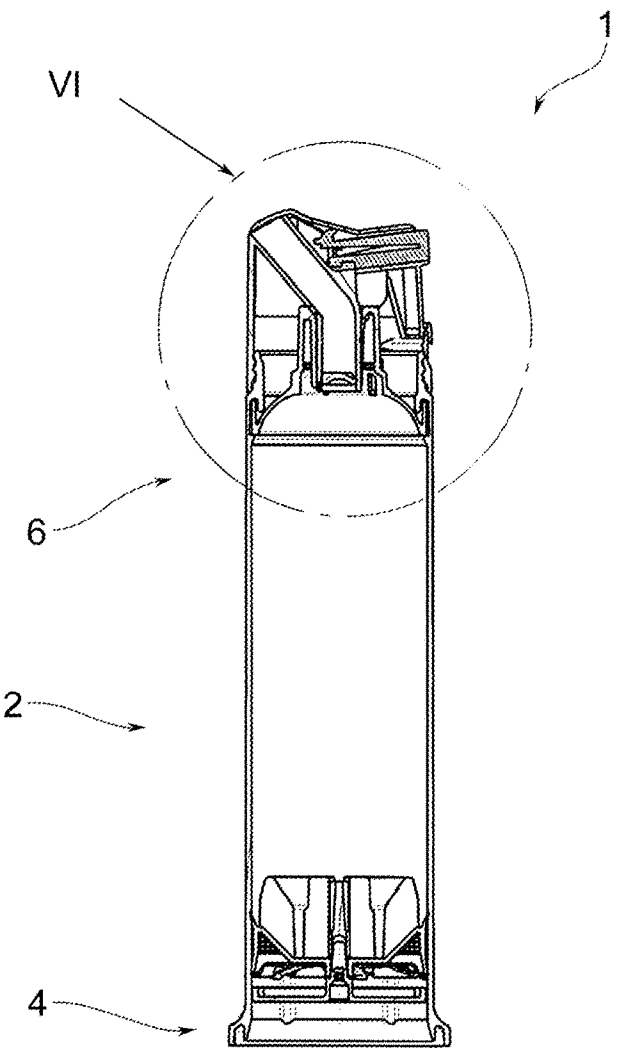
FIG. 6*a* illustrates a longitudinal section of the dispensing device of FIG. 5*a* in a rest configuration.

With reference to the accompanying figures, a dispensing device 1 for paste products, in particular for toothpaste, comprises a container 2 with a predominant extension along a longitudinal axis Z and a substantially cylindrical shape.

The container 2 extends between a lower end 4 and an upper end 6.

The device 1 further comprises a bottom structure 8 arranged in the container 2, on the lower end part 4.

The bottom structure 8 slides sealingly towards the upper end 6 by low pressure inside the container 2, without the ability to return, and provides for venting means for the escape of air trapped between the paste product and the structure itself during the operations of filling the container.

Said bottom structure 8 is described in detail in document EP 351517 in the name of the Applicant, the teaching of which is incorporated herein.

The device 1 further comprises a dispensing head 10, applied to the upper end 6 of the container 2.

Said dispensing head 10 comprises a dispensing duct 14, comprising a first section 14*a*, having extension along a first axis Z1 and equipped with an inlet opening 16, and a second section 14*b*, having extension along a second axis Z2, inclined with respect to the first axis Z1, and provided with an outlet opening 18 for dispensing the product. The first axis Z1 is preferably coincident with or parallel to the longitudinal axis Z.

Said dispensing duct 14 is delimited by a small tube having a first section 12*a* that delimits the first section 14*a* of the duct 14 and a second section 12*b* that delimits the second section 14*b* of the duct 14.

The head 10 further comprises a skirt 20 applied to an end edge 6*a* of the upper end 6 of the container 2; preferably, the tube 12 is made in one piece with the skirt 20.

The device 1 further comprises pumping means comprising a flexible diaphragm 30, attached to the top end 6 of the container, and intended to be deformed to push the product into the tube 12 through the inlet opening 16. Preferably, said diaphragm 30 is shaped like a cap.

In addition, said pumping means comprise a sleeve 32 arranged around the first section 12*a* of the tube 12 and sealingly slidable on the outer surface thereof.

Preferably, the diaphragm 30 and the sleeve 32 are made as a single piece.

Additionally, said pumping means comprise a shut-off valve 50; for example, said valve 50 comprises an obturator 52, for example, made as a single piece with the diaphragm 30.

In the rest configuration, the obturator 52 closes the inlet opening 16 of the tube 12; in the dispensing configuration, the obturator 52, following the deformation of the diaphragm 30, frees at least part of the inlet opening 16.

Advantageously, said closing valve prevents the paste product from entering the tube during filling operations from the bottom of the container.

Additionally, the head 10 comprises actuation means to manually activate said pumping means.

Preferably, said actuation means comprise a button 40, applied, for example, to the skirt 20, for example, rotatably. Said button is suitable for switching from a rest position in the rest configuration to a dispensing position in the dispensing configuration, wherein it operates on the pumping means causing the deformation of the diaphragm.

In particular, for example, said button 40 in the dispensing position engages the sleeve 32 of the pumping means, pushing it downwards, starting from the position occupied in the rest configuration.

The sleeve 32 slides sealingly on the first section 12*a* of the tube 12 and causes the deformation of the diaphragm 30, which pushes the product into the tube 12 until it is dispensed through the outlet opening 18.

Preferably, said actuation means comprise means for closing the outlet opening 18.

For example, said actuation means comprise a door portion 42 of the button 40; when the button 40 is in the rest position, said door portion 42 closes the outlet opening 18, while when the button is in the dispensing position, the door portion 42 frees said outlet opening 18 at least partially.

According to the first embodiment of the invention (FIGS. 1*a* to 4*b*), the button 40 preferably has a pressure surface 44, for example contiguous to the door portion 42, lying essentially on an imaginary plane orthogonal to the longitudinal axis Z or slightly inclined, while laterally there is provided an outer side surface 46 delimiting said button laterally.

Inside the button 40, the pressure surface 44 and the side surface 46 delimit an extension compartment 48.

According to said embodiment, the actuation means comprise an extension element 60', applied rotatably to the button 40, suitable for changing from a rest position in the rest configuration, wherein it is contained in the extension compartment 48, to an active position in an extension configuration, wherein it protrudes from the extension compartment 48 and so that an extension portion 62 thereof extends said pressure surface 44.

For example, said extension element 60' comprises a stop portion 64 and an extension portion 62, angled therebetween, for example at 90°.

For example, between the stop portion 64 and the extension portion 62 is arranged a rotation axis X through which said extension element 60' is hinged to the button 40.

In a rest configuration (FIG. 2*b*), the extension element 60' is in a first angular position wherein it is essentially entirely contained in the extension compartment 48 of the button 40.

In particular, in said first angular position, the stop portion 64 has an outer surface 64*e* essentially level with the pressure surface 44 of the button 40.

At the same time, in said first angular position, the extension portion 62 has an outer surface 62*e*, within the side surface 46 of the button 40.

By rotation of the extension element 60' (FIG. 3*b*), said extension element reaches an extension configuration wherein the extension portion 62 is arranged as an extension of the pressure surface 44 of the button 40; for example, the outer surface 62*e* of the extension portion 62 is arranged essentially level with the pressure surface 44 of the button 40.

Preferably, moreover, the stop portion 64 of the extension element 60' abuts against an abutment wall 49 of the button 40, to prevent further rotation in the same direction as the extension element 60' and to convey to the button 40 any action carried out by the user only on the extension element 60'.

Pressing the button 40 (FIG. 4*b*), which is permitted by a pressure action on the extension portion 62, as well as on the pressure surface 44 of the button 40, brings the device into the dispensing configuration, with deformation of the diaphragm 30.

Such action is certainly facilitated by the extension portion 62, which, ideally lengthening the pressure surface 44 of the button 40, produces an increased leverage effect.

According to a further embodiment of the invention (FIGS. 5*a* to 8*b*), the button 40 has a pressure wall 44' having an outer pressure surface 44, for example contiguous to the door portion 42, lying essentially on an imaginary plane orthogonal to the longitudinal axis Z or slightly inclined relative thereto, while laterally there is provided a side surface 46 delimiting said button laterally.

Below the pressure wall 44', the button 40 has a pocket 51, open on the side surface 46.

According to said embodiment, the actuation means comprise an extension element 60", slidingly applied to the button 40, within the pocket 51.

Figure 7B:
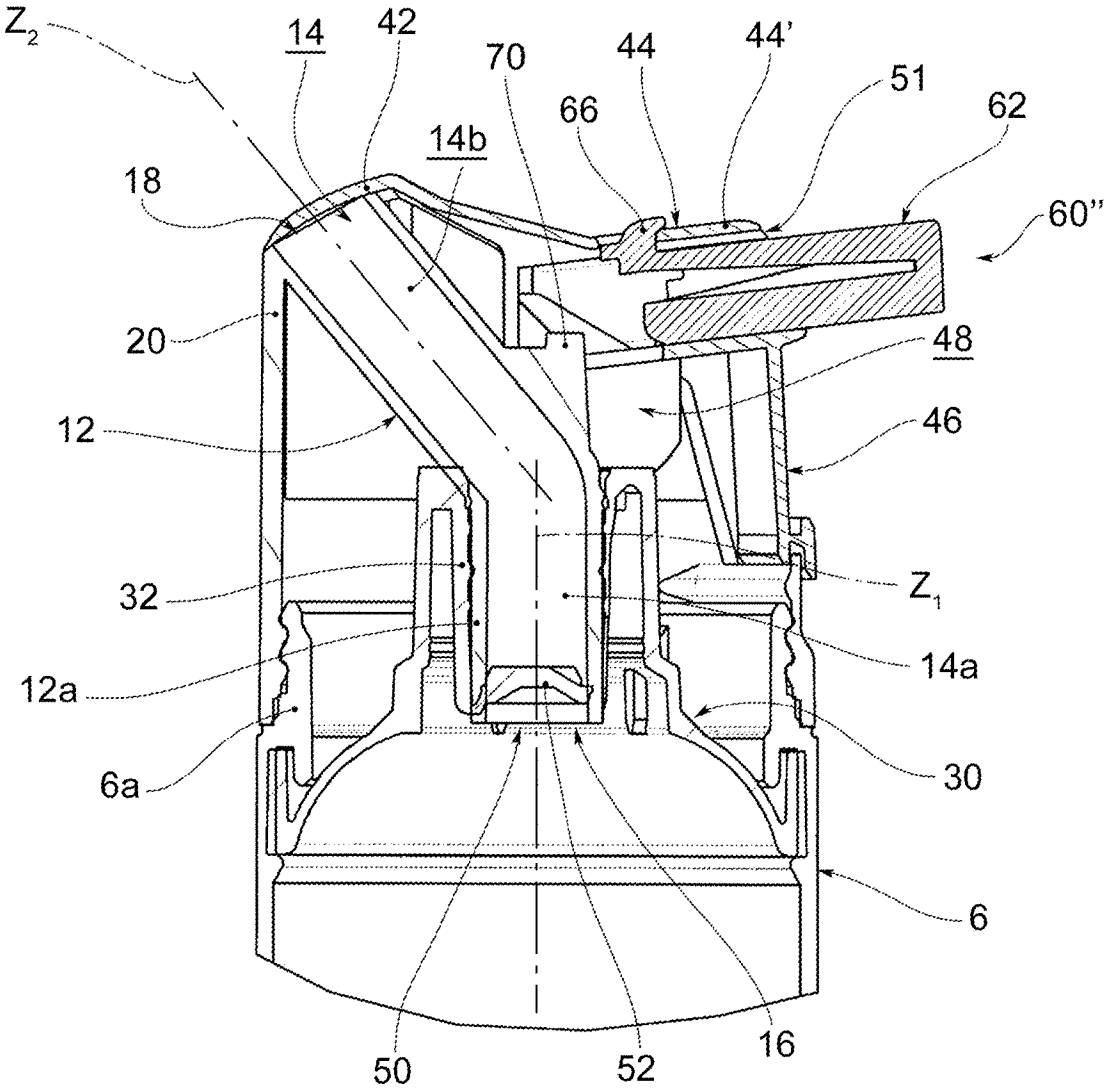
FIG. 7*b* shows an enlargement of the detail VII of FIG. 7*a;*
Figure 7A:
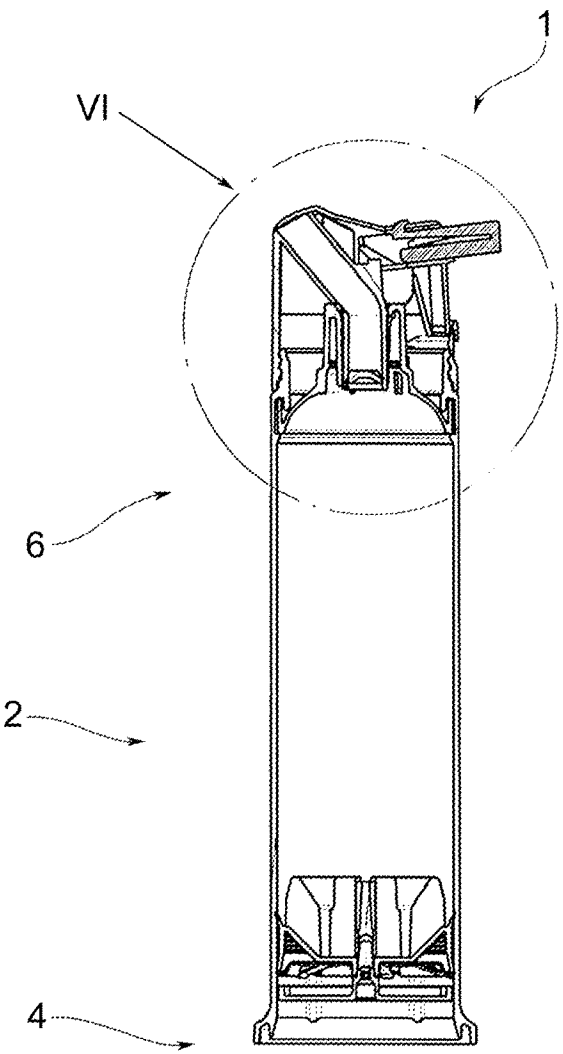
FIG. 7*a* illustrates a longitudinal section of the dispensing device of FIG. 5*a* in an extended configuration.
Figure 8B:
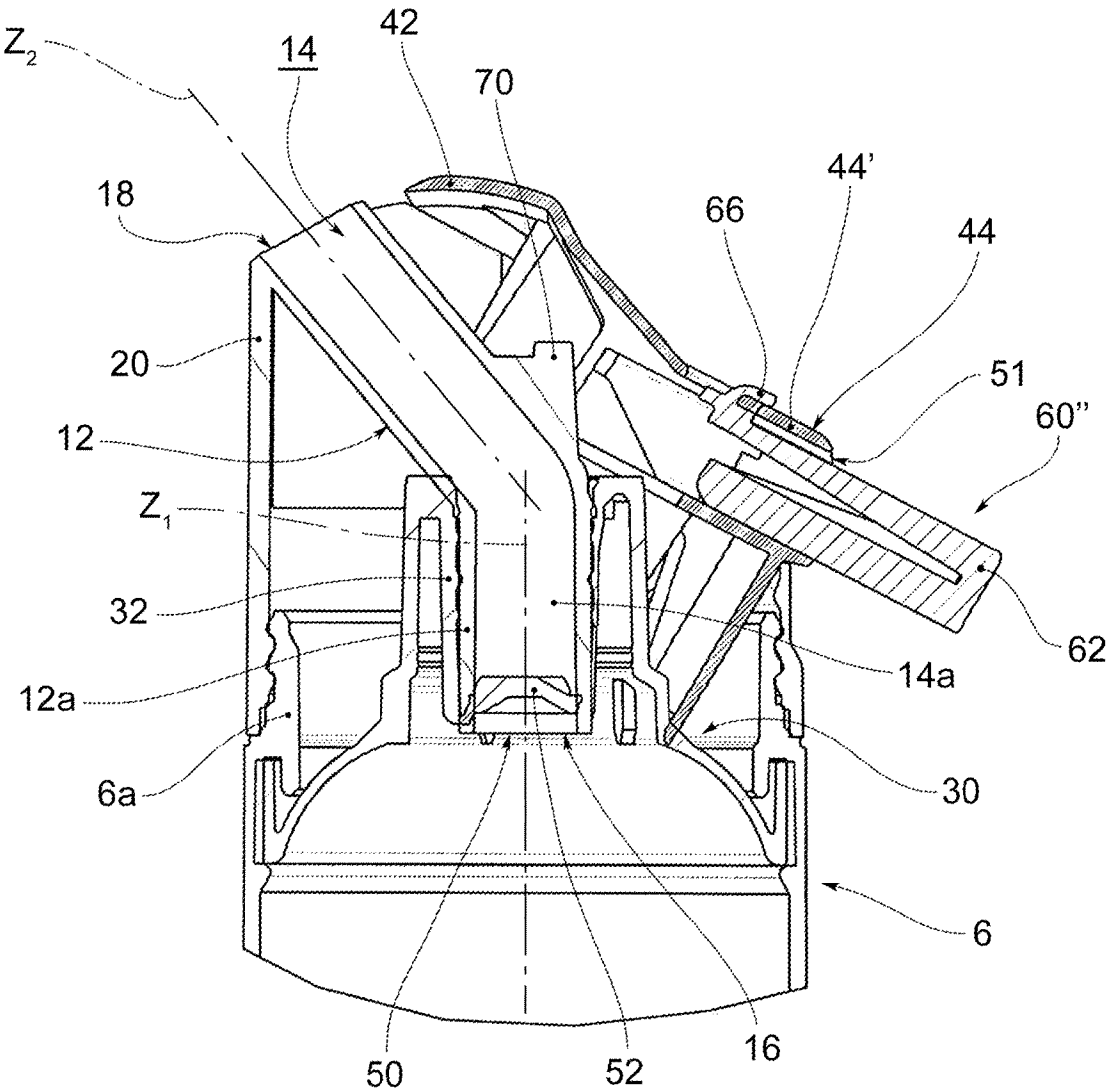
FIG. 8*b* shows an enlargement of the detail VIII of FIG. 8*a.*
Figure 8A:
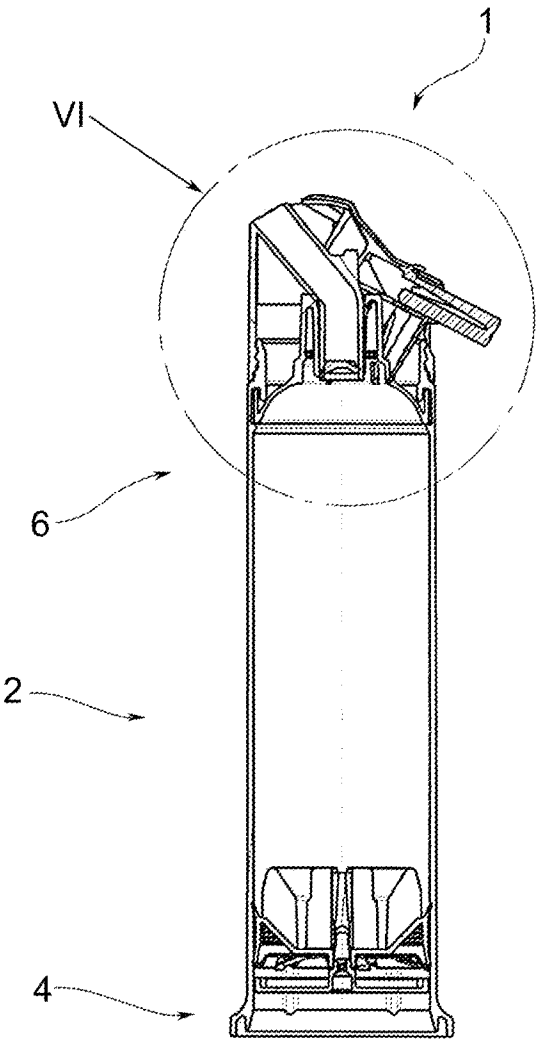
FIG. 8*a* illustrates a longitudinal section of the dispensing device of FIG. 5*a* in a dispensing configuration.

The extension element 60" is suitable for changing from a rest configuration, wherein it is mainly contained in the pocket 51 (FIG. 6*b*), to an extension configuration, wherein it is mainly protruding from the pocket 51 in such a way that, with its extension portion 62, it extends said pressure surface 44 (FIG. 7*b*).

Preferably, moreover, stop means are provided suitable for stopping the sliding of the extension element 60" toward the outside of the pocket 51 to prevent its complete detachment.

Said stop means preferably comprise a hook 66 protruding from the extension portion 62 of the extension element 60" and a window 68 obtained through the pressure wall 44'.

From the rest position of the rest configuration, by pulling out the extension element 60", the hook 66 snaps into the window 68, locking the sliding and defining the active position of the extension configuration.

Pressing the button 40 (FIG. 8*b*), which is permitted by a pressure action on the extension portion of the extension element 60", as well as on the pressure surface 44 of the same button 40, brings the device into the dispensing configuration.

Such action is certainly facilitated by the extension portion 62, which, ideally lengthening the pressure surface of the button, produces an increased leverage effect.

The head 10 according to the invention further comprises locking means integrated with said extension element 60', 60", suitable to prevent the actuation of the button 40 when said extension element 60', 60" is in the rest position.

For example, said locking means comprise a locking wall 70 of the head 10 (FIG. 6*b*), for example, protruding from the tube 12, and the extension element 60", in the rest position, which engages said locking wall 70 with a locking portion 72 so as to prevent the button 40 from lowering.

Once the extension element 60" has been moved into the active position (FIG. 7*b*), the locking wall 70 is disengaged from the locking portion 72 and the button 40 is permitted to lower.

Innovatively, the dispensing device according to the present invention meets the needs of the sector, as it facilitates the dispensing of paste products, and at the same time overcomes the drawbacks mentioned, in that in the rest configuration, the size of the button is virtually identical to that of traditional devices.

It is clear that one skilled in the art, in order to meet contingent needs, may make changes to the dispensing device described above, all contained within the scope of protection defined by the accompanying claims.

What is claimed is:

1. A dispensing device for paste products, including toothpaste, the dispensing device comprising:

a container extending along a longitudinal axis between a lower end and an upper end;

a deformable diaphragm located at the upper end;

a head applied to the upper end of the container to overlap the deformable diaphragm, the head comprising:

a tube provided with an inlet opening and an outlet opening; and a button for acting on the deformable diaphragm and deforming it for dispensing a product through the tube, wherein the button has a pressure surface for a dispensing action of a user; and an extension element for passing from a rest position, wherein it is mainly housed in the button, to an active position, wherein it is mainly outside the button, the extension element providing an extension portion which, in the active position, is arranged as an extension of the pressure surface of the button.

2. The dispensing device of claim 1, wherein the extension element is rotatable between the rest position and the active position.

3. The dispensing device of claim 2, wherein the button has a side surface delimiting the button laterally and, inside the button, the pressure surface and the side surface delimit an extension compartment wherein the extension element is mainly housed in the rest position.

4. The dispensing device of claim 2, wherein the extension element comprises a stop portion, angled at 90°, relative to the extension portion.

5. The dispensing device of claim 4, wherein a rotation axis for hinging to the button is arranged between the stop portion and the extension portion.

6. The dispensing device of claim 4, wherein, in the rest position of the extension element, the stop portion has an outer surface substantially level with the pressure surface of the button.

7. The dispensing device of claim 4, wherein in the rest position, the extension portion has an outer surface within the side surface of the button.

8. The dispensing device of claim 7, wherein, when the extension element is in the active position, the outer surface of the extension portion is arranged substantially level with the pressure surface of the button.

9. The dispensing device of claim 4, wherein the stop portion, in the active position of the extension element, abuts against an abutment wall of the button.

10. The dispensing device of claim 1, wherein the extension element is slidable between the rest position and the active position.

11. The dispensing device of claim 10, wherein the button comprises a pressure wall having externally the pressure surface and, below the pressure wall, an inner pocket, wherein the extension element is mainly housed in the rest position.

12. The dispensing device of claim 11, further comprising stop means for stopping sliding of the extension element toward the outside of the inner pocket to prevent a complete detachment thereof.

13. The dispensing device of claim 12, wherein the stop means comprise a hook projecting from the extension portion and a window obtained through the pressure wall, the hook being snap-engageable in the window in the active position.

14. The dispensing device of claim 1, further comprising locking means integrated with the extension element, to prevent actuation of the button when said extension element is in the rest position.

15. The dispensing device of claim 14, wherein the locking means comprises a locking wall of the head and a locking portion of the extension element engaging, in the rest position, the locking wall, and preventing actuation of the button.

* * * * *